US007216484B2

(12) United States Patent
Villalobos

(10) Patent No.: US 7,216,484 B2
(45) **Date of Patent: *May 15, 2007**

(54) ARC-HYDROLYSIS STEAM GENERATOR APPARATUS AND METHOD

(76) Inventor: Victor M. Villalobos, 2955 Summitop Ct., Marietta, GA (US) 30066

( * ) Notice: Subject to any disclaimer, the term of this patent is extended or adjusted under 35 U.S.C. 154(b) by 0 days.

This patent is subject to a terminal disclaimer.

(21) Appl. No.: 11/078,598

(22) Filed: Mar. 11, 2005

(65) Prior Publication Data

US 2006/0201157 A1 Sep. 14, 2006

(51) Int. Cl.
*F01K 13/00* (2006.01)

(52) U.S. Cl. ..... 60/645; 60/670

(58) Field of Classification Search ..... 60/645, 60/670

See application file for complete search history.

(56) References Cited

U.S. PATENT DOCUMENTS 3,628,164 A 12/1971 Tikhomirov et al.
3,648,668 A 3/1972 Pacheo
3,663,855 A 5/1972 Boettcher
3,821,580 A 6/1974 Alexandrovich et al.
3,946,711 A 3/1976 Wigal
4,009,416 A 2/1977 Lowther
4,194,239 A 3/1980 Jayaram et al.
4,271,793 A 6/1981 Valdespino
4,344,831 A 8/1982 Weber
4,428,905 A * 1/1984 Phillips et al. ..... 376/323
4,595,975 A 6/1986 Gray, Sr.
5,159,900 A 11/1992 Dammann
5,326,530 A * 7/1994 Bridges ..... 422/22
5,409,784 A * 4/1995 Bromberg et al. ..... 429/13
5,416,391 A 5/1995 Correa et al.
5,417,817 A 5/1995 Dammann et al.
5,435,274 A 7/1995 Richardson, Jr.
5,449,989 A 9/1995 Correa et al.
5,502,354 A 3/1996 Correa et al.
5,614,332 A * 3/1997 Pavelle et al. ..... 429/68
5,616,307 A * 4/1997 Dubin et al. ..... 423/235
5,792,325 A 8/1998 Richardson, Jr.
5,826,548 A 10/1998 Richardson, Jr.
5,847,353 A * 12/1998 Titus et al. ..... 219/121.36
5,887,554 A * 3/1999 Cohn et al. ..... 123/3
6,126,794 A 10/2000 Chambers
6,127,645 A * 10/2000 Titus et al. ..... 219/121.36
6,183,604 B1 2/2001 Santilli
6,257,175 B1 7/2001 Mosher et al.
6,299,738 B1 10/2001 Richardson, Jr.
6,540,966 B1 4/2003 Santilli (Continued)

OTHER PUBLICATIONS

U.S. Appl. No. 11/217,823, filed Sep. 1, 2005, Villalobos.

(Continued)

*Primary Examiner*—Hoang Nguyen
(74) *Attorney, Agent, or Firm*—Williamson Intellectual Property Law, LLC; Thomas R. Williamson, III

(57) ABSTRACT

An arc-hydrolysis steam generator apparatus and method of use thereof, the steam generator comprising of an arc-plasma hydrolysis using a high pressure vessel and electrodes exposed to high frequency, high amperage pulses and an inductor placed around an arc-hydrolysis unit, wherein the inductor recovers magnetic energy generated by the electric arc discharge to supplement the steam energy recoverable from water by the arc-hydrolysis unit.

8 Claims, 5 Drawing Sheets

U.S. PATENT DOCUMENTS

| | | | | |
|---|---|---|---|---|
| 6,663,752 | B2 | 12/2003 | Santilli | |
| 6,673,322 | B2 | 1/2004 | Santilli | |
| 6,790,324 | B2 | 9/2004 | Chambers | |
| 6,886,340 | B1 * | 5/2005 | Pierce, Jr. | 60/645 |
| 6,926,872 | B2 | 8/2005 | Santilli | |

OTHER PUBLICATIONS

U.S. Appl. No. 11/029,119, filed Jan. 4, 2005, Villalobos.

Naudin, J.L.; "*More experiment with the APE: Electrical power from the plasma?*"; Web Article, Jan. 17, 2006, pp. 1-15; JNL Labs (Mar. 2, 2006).

Naudin, J.L.; "*Do it yourself experiment: The asymmetrical plasma electrolysis (APE) experiment?*"; Web Article, Oct. 5, 2005, pp. 1-13; JNL Labs (Jan. 17, 2006).

Naudin, J.L.; "*The CFR Project: a high temperature plasma electrolysis*"; Web Article, May 8, 2005, pp. 1-11; JNL Labs (Feb. 16, 2006).

* cited by examiner

ARC-HYDROLYSIS STEAM GENERATOR APPARATUS AND METHOD

PRIORITY CLAIM

To the fullest extent permitted by law, the present continuation-in-part non-provisional patent application claims priority to, and the full benefit of, U.S. Non-provisional Patent Application entitled "ARC-HYDROLYSIS FUEL GENERATOR WITH SUPPLEMENTAL ENERGY RECOVERY", filed on Jan. 4, 2005, having assigned Ser. No. 11/029,119.

TECHNICAL FIELD

The present invention relates generally to a steam generator, and more specifically to a steam generator apparatus and process for generation of steam and energy generator therefrom, wherein the steam is generated by arc-hydrolysis of water, and wherein supplemental electrical energy is recovered from an electrical arc via induction.

BACKGROUND OF THE INVENTION

As concerns about our nation's dependence on foreign oil increase, and as Americans become more aware of the resulting direct effect on the economy of the country and of environmental impacts of foreign petroleum use, interest has increased for domestically-produced alternative methods for fueling transportation engines, as well as methods for generation of electrical energy.

Electrolysis has long been a method of choice to break compounds into their component molecules. Hydrolyzing water to produce steam and heat through the use of electrical energy at electrodes is called electrolysis, in this instance, water electrolysis. By subjecting water to a pair of electrodes to a electrical energy, a cold or low voltage anode and a hot or high voltage anode within a pressurized vessel, there will result the formation of pressurized steam.

In order to provide for more rapid electrolysis of water, it is desirable to inject more electrical energy into the water surrounding the electrodes to thereby break apart more water molecules rapidly and creating heat which becomes steam once is pressurized. One method of injecting large amounts of energy into the water to make steam is through electrodes is via an electric arc, this process is called arc-hydrolysis.

Electric arcs have been utilized for ionization and/or hydrolysis of water, wherein the energy released in the formation of the spark breaks apart the water molecule into its component hydrogen and oxygen elements. In hydrolyzing water, the arc must take place under water and is thus known as arc-hydrolysis.

Arc-hydrolysis of water will result in the production of a great deal of heat, wherein the temperature of the hot anode reaches approximately 6000 degrees Fahrenheit or more.

In order to stabilize the pattern of dependency on foreign oil, in addition to creating employment in a new industry, it is desirable to both generate high pressure steam and to recover electrical energy utilized in producing the steam.

Accordingly, it is advantageous to make the arc-hydrolysis process more efficient and/or to recover the heat energy through other means, steam production is one form of energy recovery. Efficiency improvement has been accomplished by adding salts to the water to facilitate ionic transfer between the electrodes. A large quantity of energy is generated in the form of heat in the electric arc discharge by the use of arc-hydrolysis.

Therefore, it is readily apparent that there is a need for an apparatus and method for generation of high-pressure steam via arc-hydrolysis, with supplemental electrical recovery of energy residing in the arc plasma.

BRIEF SUMMARY OF THE INVENTION

Briefly described, in a preferred embodiment, the present invention overcomes the above-mentioned disadvantages and meets the recognized need for such a device by providing an arc-hydrolysis steam generator with supplemental energy recovery, via an inductor, from the magnetic field formed by an arc discharge utilized for electrolyzing water. The arc-hydrolysis steam generator of the present invention recovers wasted radiating energy and water vapor that would otherwise be lost, thereby providing for higher efficiency of conversion of electrical energy to steam.

According to its major aspects and broadly stated, the present invention in its preferred form is an arc-hydrolysis steam generator and method of use thereof, wherein an inductor is placed around an arc-hydrolysis unit, and wherein the inductor recovers magnetic energy generated by the electric arc discharge, to supplement the recoverable steam energy. The recovered energy is returned to the arc-hydrolysis unit, whereby the recovered energy reduces the quantity of electrical energy required to provide a subsequent arc discharge. It is noted that the steam is produced concurrent with the electrolysis/magnetic energy recovery.

Additionally, water vapor in the form of condensate exhausted by the steam is circulated and returned to the process, thereby reducing the quantity of water required to produce energy.

More specifically, the present invention is an arc-hydrolysis steam generator with supplemental energy recovery and process therefore, wherein a source material, such as water, in a controlled high-pressure container is subjected to an electric arc discharge. Submerged arc-hydrolysis utilizes a high energy, high amperage controlled DC pulse to produce a spark, or arc, in a solution comprised water with a small percentage of salt (NaCl), whereby the solution is ionized into steam comprised hydrogen and oxygen in the form of high pressure steam, via the application of a high electrical energy amperage.

The steam produced is subsequently fed to an steam turbine, wherein rotational energy is produced, thereby producing rotational energy for use in sustaining rotation power for transportation purposes such as automobiles, cars, boats, etc, etc or for producing electrical energy. It will be recognized by those skilled in the art that mechanical energy from the steam turbine could selectively be utilized with or without producing electrical energy via electrical generator for other heating applications as well. The steam turbine provides rotational energy, such as for pumping water, or powering a vehicle.

Magnetic field energy is recovered from the electric arc discharge and converted into electrical energy by an inductor, to increase the overall efficiency of the arc-hydrolysis steam generator and its process.

In addition to fueling steam turbines, the heat produced by the arc-hydrolysis can be utilized as an environmentally desirable method to heat or cool homes (thru absorption refrigeration) as well as clean and disinfect water or organic materials contaminated by bacteria, and/or desalinize water.

In order to achieve maximization of the desired results of the present invention, it is necessary to recapture the radiated wasted energy that would normally be lost from the arc discharge. The electric arc discharge forms a radiating electromagnetic event, wherein the electromagnetic event is produced and a magnetic envelope is created around the arc when a high energy direct current pulse is discharged across a spark gap. The pulse should be steady, extremely short in duration, and sharp in nature, with fast, abrupt interruption to produce the greatest radiating electromagnetic event and magnetic field for capture by an inductor.

A highly visible light effect is produced when the cold low voltage anode is exposed to the high-voltage anode (as high as 3000 volt) positive potential discharge. When the low voltage switch on the low voltage side is open, a high voltage positive potential forms across anodes, wherein electrons are drawn to the anodes, and, subsequently, when a switch is quickly closed and re-opened (as short as 0.00005 sec), an arc forms at the arc point between the low voltage anode and the high voltage anode of approximately 5000 kVA potential or higher. A plasma is formed from the arc discharge, wherein the plasma ionizes a solution there around, takes place and the electrons give up quanta or photons of electromagnetic nature, yielding a highly visible luminous light and extreme heat which converts the water into steam when water is heated and pressurized.

Specifically, the steady stream of sharp direct current pulses promotes ionization of the solution atoms during the upward leg of the pulse while creating an arc plasma condition and a pulsating electromagnetic radiant event in the downward leg of the pulse as it collapses. The high voltage direct current pulses produced across the arc point are sharply interrupted, abrupt and very short in duration (0.00005 sec to 0.01 sec), to obtain a maximum ratio of ionization rate to recycling rate of electric energy.

The steady direct current pulses across the anodes generate two concurrent events:

a) water solution is converted into steam via heat and pressure, b) an electromagnetic radiant pulsating field, wherein the pulsating field is subsequently utilized to recover electric energy by use of a electrical energy reclaim grid comprising an inductor.

These two concurrent events tend to promote each other, first, by producing steam, and a pulsating arc plasma condition, and second, by producing an electromagnetic radiant field effect which is then converted into electrical energy.

The arc-hydrolysis steam generator with supplemental energy recovery recaptures most of the electrical energy utilized to produce the arc discharge.

Accordingly, a feature and advantage of the present invention is its ability to produce hydrogen and oxygen steam at high pressure.

Still another feature and advantage of the present invention is its ability to harvest the wasted energy created during arc-hydrolysis from the electromagnetic radiant event through utilization of the magnetic field formed.

Still a further feature and advantage of the present invention is its ability to provide cyclical rotational energy motion for transportation purposes by the use of a steam turbine.

Still another feature and advantage of the present invention is its ability to produce electrical power at the primary level such as electrical generators and secondary level at the internal reclaim circuit level.

Still yet another feature and advantage of the present invention is that it approaches near self-sufficiency for electrical energy and water.

An additional feature and advantage of the present invention is its ability to sterilize liquid materials.

Another use of the present invention is for the purposes of charging automotive and buildings batteries during off power periods of time, i.e. night time, to be used later when power is more expensive.

Yet an additional feature and advantage of the present invention is that it requires only addition of water solution and supplemental electrical energy for self-sufficiency.

Still yet an additional feature and advantage of the present invention is that it minimizes the depletion of water because it generates condensate water, which can be re-used by the process.

These and other features and advantages of the present invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Selected Alternate Embodiments with reference to the accompanying drawing figures, in which like reference numerals denote similar structure and refer to like elements throughout, and in which.

REFERENCE NUMERALS IN THE DRAWINGS

Figure 1:
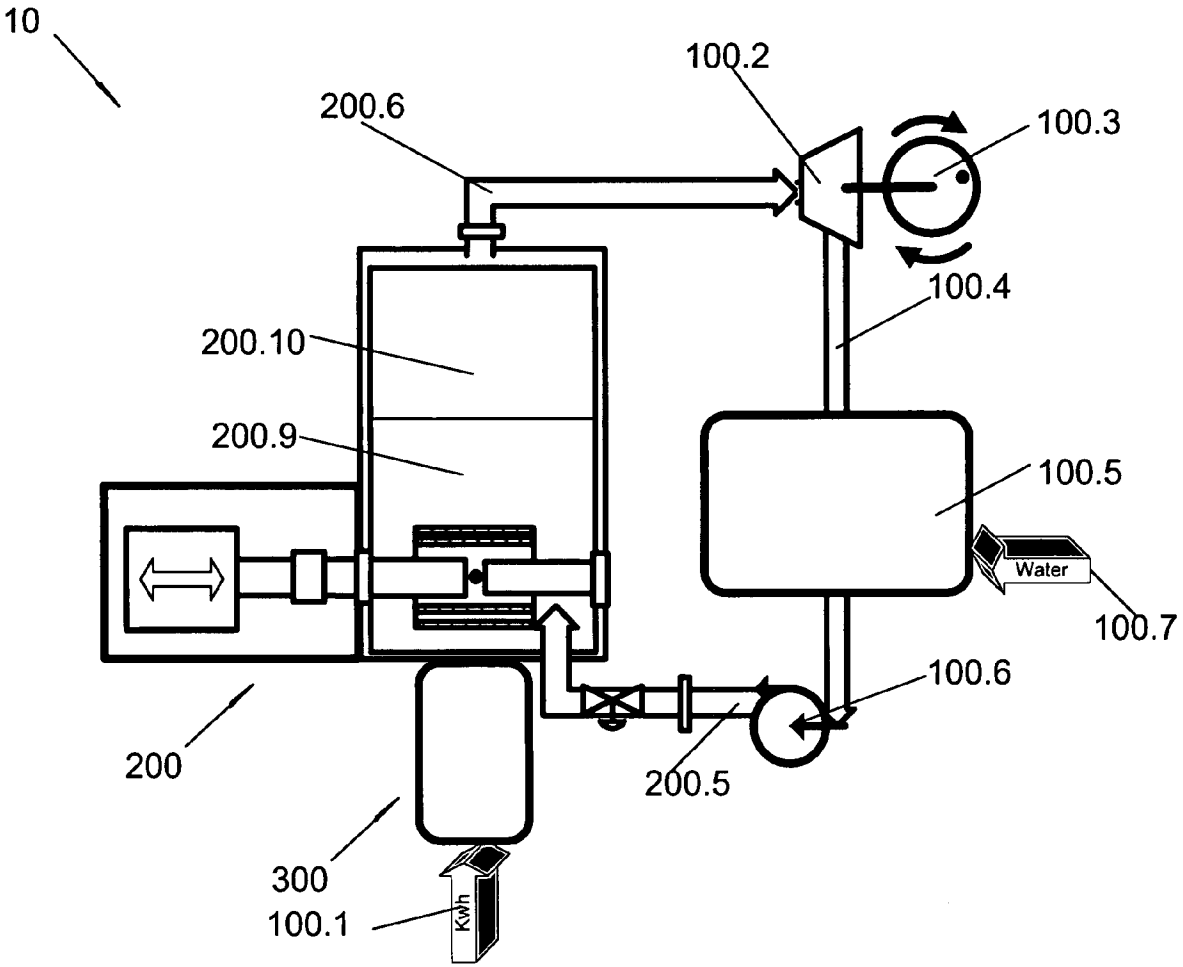
FIG. 1 is a block diagram of an arc-hydrolysis gaseous steam generator according to the preferred embodiment of the present invention.
Figure 2:
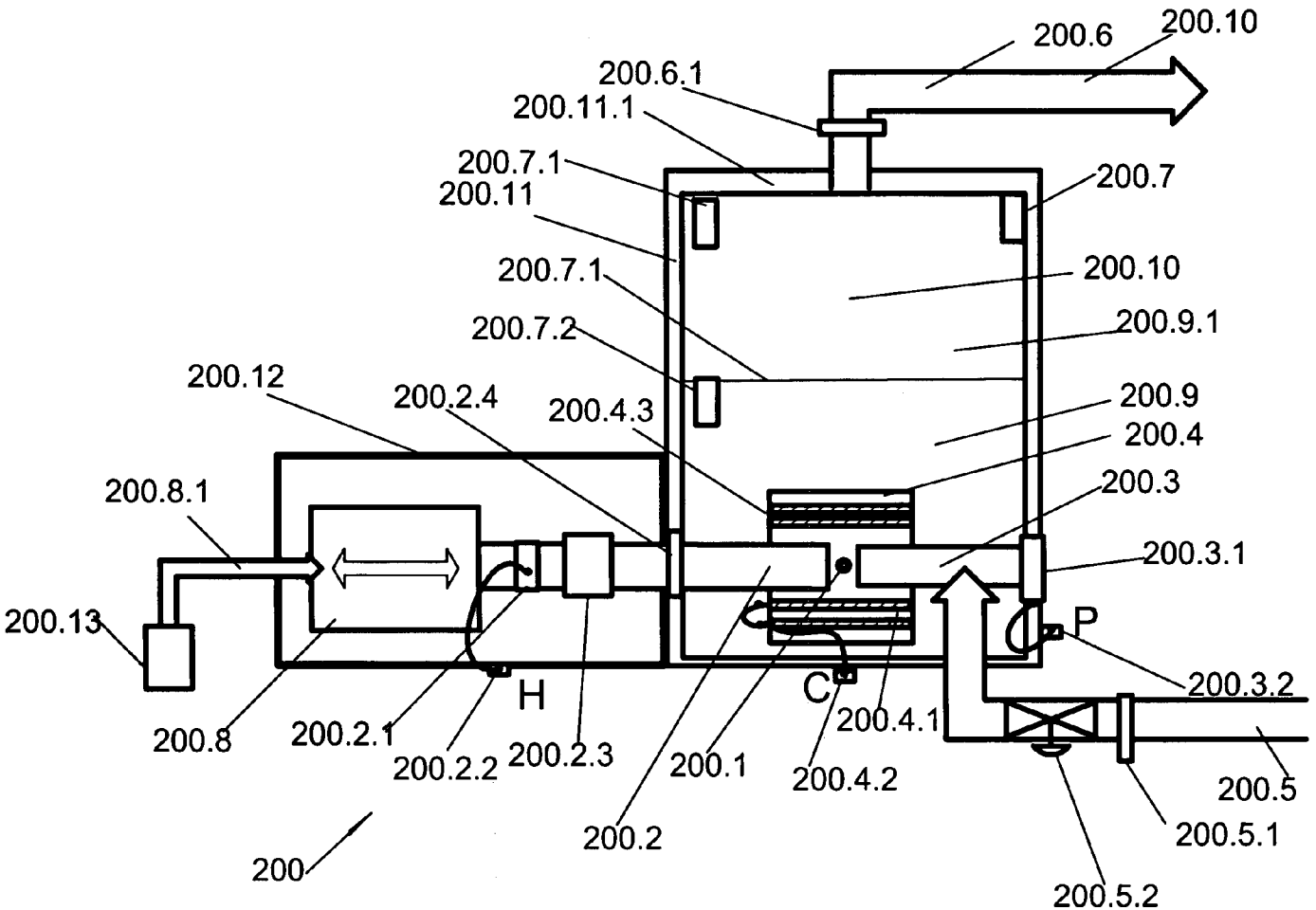
FIG. 2 is a cross-sectional view of a submerged Steam generation system component of an arc-hydrolysis steam generator according to the preferred embodiment of the present invention.

FIG. 1 10 Steam Arc-Hydrolysis
FIG. 1 100.1 Supplemental external power
FIG. 1 100.2 Steam turbine
FIG. 1 100.3 Rotational energy
FIG. 1 100.4 Condensate pipe
FIG. 1 100.5 Condensate tank
FIG. 1 100.6 Condensate pump
FIG. 1 100.7 Make up water
FIG. 2 200 Steam generation system
FIG. 2 200.1 Arc-plasma point
FIG. 2 200.2 Adjustable metal electrode
FIG. 2 200.2.1 Metal electrode
FIG. 2 200.2.2 Connection post with cable
FIG. 2 200.2.3 Electrode union
FIG. 2 200.2.4 Pressure seal
FIG. 2 200.3 Fixed electrode
FIG. 2 200.3.1 Metal electrode
FIG. 2 200.3.2 Connection post with cable
FIG. 2 200.4 Electrical Energy Reclaim grid
FIG. 2 200.4.1 Metal collector grid
FIG. 2 200.4.2 Connection post with cable
FIG. 2 200.4.3 Pyrex ring
FIG. 2 200.5 Condensate pipe
FIG. 2 200.5.1 Pressure controlling valve FIG. 2 200.6 Steam supply
FIG. 2 200.6.1 Pressure controlling valve
FIG. 2 200.7 Pressure Transducer
FIG. 2 200.7.1 Water level
FIG. 2 200.7.2 Water level transducer
FIG. 2 200.8 Gap controller
FIG. 2 200.8.1 Pneumatic pressure line
FIG. 2 200.9 Liquid mass
FIG. 2 200.10. High pressure steam
FIG. 2 200.11 High pressure vessel
FIG. 2 200.11.1 Vessel lid
FIG. 2 200.12 Side pressure vessel
FIG. 2 200.13 Air source with controller
FIG. 3 300 Electrical system
FIG. 3 300.1 Supplemental electrical power conditioner
FIG. 3 300.2 Low DC to High AC converter
FIG. 3 300.2.1 First full bridge rectifier
FIG. 3 300.2.2 High Kva condenser
FIG. 3 300.3 Battery A
FIG. 3 300.3.1 Condenser
FIG. 3 300.3.2 Second full bridge rectifier
FIG. 3 300.3.3 Transformer
FIG. 3 300.4 Battery B
FIG. 3 300.5 High frequency solid state switching device
FIG. 3 300.5.1 Fast response diode
FIG. 3 300.5.2 Variable resistance
FIG. 4 400 Alternate electrical system
FIG. 4 400.1 Supplemental electrical power conditioner
FIG. 4 400.2 Low DC to High AC converter
FIG. 4 400.2.1 First full bridge rectifier
FIG. 4 400.2.2 High Kva condenser
FIG. 4 400.3 Battery A
FIG. 4 400.3.1 Condenser
FIG. 4 400.3.2 Second full bridge rectifier
FIG. 4 400.3.3 Transformer
FIG. 4 400.3.4 Isolation diode
FIG. 4 400.3.5 Secondary electrical load
FIG. 4 400.4 Battery B
FIG. 4 400.5 High frequency solid state switching device
FIG. 4 400.5.1 Fast response diode
FIG. 4 400.5.2 Variable resistance
FIG. 5 500.1 Steam generator Unit
FIG. 5 500.2 Steam generator Unit
FIG. 5 500.3 Steam supply
FIG. 5 500.4 Steam turbine
FIG. 5 500.5 Rotational energy
FIG. 5 500.6 Condensate pipe
FIG. 5 500.7 Condensate tank
FIG. 5 500.8 Condensate pump
FIG. 5 500.9 Condensate return pipe
FIG. 5 500.10. Electrical generator
FIG. 5 500.11 Primary electrical load
FIG. 5 500.12 Secondary electrical load
FIG. 5 500.13 Secondary electrical load

DETAILED DESCRIPTION OF THE PREFERRED AND SELECTED ALTERNATIVE EMBODIMENTS

In describing the preferred and selected alternate embodiments of the present invention, as illustrated in FIGS. 1–5, specific terminology is employed for the sake of clarity. The invention, however, is not intended to be limited to the specific terminology so selected, and it is to be understood that each specific element includes all technical equivalents that operate in a similar manner to accomplish similar functions.

Referring now more specifically to FIG. 1, the present invention in the preferred embodiment is arc-hydrolysis steam generator 10 comprising Supplemental electrical external power 100.1, Electrical system 300, Steam generation system 200 and its vessel, steam turbine 100.2, Rotational energy system 103, Condensate return pipe 100.4, Condensate tank 100.5 and Condensate pump 100.6. Arc-hydrolysis steam generator 10 preferably utilizes electrical energy to power the electrical arc-plasma point 200.1 to ionize the fluid via electrodes, and comprises a fluid in the form of water 200.9, which is then converted into steam 200.10.

Steam generation system 200 is preferably in fluid communication with Steam turbine 100.2, wherein Steam turbine 100.2 preferably receives high pressure steam 200.10 via pipe 200.6, and wherein high pressure steam 200.10 flows thru steam generation system 200 via supply pipe 200.5. Steam 200.10 is preferably returned to Steam generation system 200 thru Condensate tank 100.5 via Condensate return pipe 200.5 and Condensate return pump 100.6. Condensate return pump 100.6 is preferably powered by electrical energy or rotational energy generated by the Steam turbine 100.2 or the electrical reclaimed by the Electrical reclaim grid 200.4.

Steam generation system 200 is preferably in fluid communication with Steam turbine 100.2 via steam supply 200.6, wherein Steam turbine 100.2 utilizes steam, thereby producing rotational energy 100.3. In addition to supplying fuel for Steam turbine 100.2, steam generation system 200 preferably provides steam for external uses via external fuel line 200.6 if desired.

Steam generation system 200 can preferably be regulated thru the use of DC high amperage pulses, high pressure and high temperature for the generation of the steam energy. Heat energy selectively produced could be utilized for a variety of processes, such as, for exemplary purposes only, environmental heating and cooling (absorption refrigeration), industrial steam purposes, heating water. If steam production is desired, then pressure and temperature must be adjusted thru Pressure controlling valves 200.2 and 200.6.1, pump 200.5 to permit fluid 200.9 flow and brisk arc-plasma activity 200.1 to produce the desired higher pressure steam within the vessel itself. Electrical activity and DC energy pulses are controlled by Electrical system 300.

Condensate water tank 100.5 preferably in fluid communication with Steam turbine 100.2 collects steam condensate via condensed water supply pipe 100.4. Condensate return pipe 200.5, wherein condensate water preferably flows from Condensate tank 100.5 thru Condensate pump 100.6 to Steam generation system 200 and returns to the Steam turbine 100.2 where it is converted into steam 200.10 to re-start the cycle. Processed fluids then converted into steam 200.10 at Steam generation system 200 preferably exit Steam generation system 200 via processed steam pipe output pipe 200.6.

Electrical energy is required for initiation operation of arc-hydrolysis steam generator 10. Such electrical energy is preferably supplied to Electrical system 300 from Supplemental electrical energy source 100.1 or from battery 300.3 or battery 300.4 respectively. Supplemental electrical energy source 100.1 provides electrical energy to Steam generation system 200 for commencement of operation of steam generation system 200 and/or for charging batteries 300.3 and 300.4.

Steam generation system 200 vessel preferably operates at a very high temperature (5000 to 6000 degrees Fahrenheit). For one (1) standard 100 KWh arc-hydrolysis steam generator 10, about 340,000 BTU/hour (100 KWh) or more need to be utilized, dissipated or removed; otherwise, the process will generate excessive heat which will be wasted which will otherwise destroy the system itself if not properly utilized. Steam supply pipe 200.6 and condensate recovery pipe 200.5 preferably functions to keep Steam generation system 200 and condensate water re-circulating and provided with water solution 200.9 by using Pump 100.6 to push or by its own pressure in the vessel. The produced heat is fed in the form of steam to Steam turbine 100.2 for use in producing rotational energy which can be utilized to generate electricity thru a generator unit or for transportation purposes. That is, the heat in the form of steam is preferably utilized to power the Steam turbine unit 100.2 to produce a rotational energy; however, the generated steam can be used contiguously for other uses such as generating electricity by driving electrical generators or as a heating source for use in heating homes and buildings as well as other uses.

Pump 100.6, Condensate tank 100.5, Steam turbine 100.2, Steam generating unit 200 as well as pipes 200.6, 100.4 and 200.5, Electrical System 300, respectively, can be designed and sized by one skilled in the art to facilitate the desired steam output capacity and heating requirements desired.

Referring now more specifically to FIG. 2, in the preferred embodiment, the Steam generation system 200 comprises high voltage hot anode 200.2 and low voltage cold anode 200.3, wherein arc point 200.1 is disposed between high voltage hot anode 200.2 and low voltage cold anode 200.3. Steam generation system 200 further comprises Electrical energy reclaim grid 200.4, wherein Electrical energy reclaim grid 200.4 is preferably disposed around high voltage hot anode 200.2, arc point 200.1.1, and low voltage cold anode 200.3, and wherein collector cable 200.4.2 preferably provides electrical communication between Electrical energy reclaim grid 200.4 and collector electrode terminal 200.4.2. Preferred low voltage cold anode 200.3 made out of Tungsten or other hard metal material passes through cold electrode seal ring 200.3.1, wherein high voltage cold anode 200.2 preferably comprises Tungsten or other hard metal material passes through cold electrode seal ring 200.2.4. Hot electrode seal ring 200.2 is preferably in electrical communication with hot electrode terminal 200.2.2 via hot electrode cable 200.2.2, wherein cable 200.2.2 should preferably be able to carry high current of approximately 20 amps or higher depending on the size of the application.

Arc chamber 200.9.1 preferably comprises PYREX ring 200.4.3, liquid level 200.9, Steam 200.10, metal pressure seal ring 200.3.1, metal pressure seal ring 200.2.4, wherein pressure seal ring 200.3.1 is preferably in electrical communication with cold electrode terminal 200.3.2 via cold electrode cable 200.3.2, wherein cable 200.3.2 should preferably be able to carry high current of approximately 20 amps or higher depending on application, and including metal pressure seal ring 200.2.4, pressure seal ring 200.2.4, wherein pressure seal ring 200.2.4 is preferably in electrical communication with hot electrode terminal 200.2.2 via cold electrode cable 200.2.2, wherein cable 200.2.2 should preferably be able to carry high current of approximately 20 amps or higher depending on application Arc chamber 200.9.1 is preferably fed with water 200.9 via Condensate pipe 200.5 and Steam 200.10 is preferably returned to Steam turbine 100.2 via Return pipe 200.6.

Steam generation system 200 preferably comprises any magnetically inert material and able to stand high pressures (100–400 psi), such as, for exemplary purposes only, ceramic material. PYREX ring 200.4.3 is preferably provided as a component of the Steam generation system 200, wherein PYREX ring 200.4.3 is formed from borosilicate glass, or other non-magnetic material that can withstand high temperatures, and wherein PYREX ring 200.4.3 preferably functions to protect Electrical energy reclaim grid 200.4 from potential corrosion and abrasive action of high pressure steam 200.10. Electrical energy reclaim grid 200.4 is preferably copper, or other highly conductive material, formed into one or several copper rings preferably embedded within PYREX ring 200.4.3. In the preferred form, Electrical energy reclaim grid 200.4 acts as an electromagnetic antenna and collects radiated magnetic energy formed by the collapse of the high current spark discharge at arc point 200.1.1.

During the preferred use, Steam generation system 200 preferably contains water solution in the liquid form 200.9. A spark is generated in arc chamber 200.9.1 at arc point 200.1.1, between high voltage hot anode 200.2 and low voltage cold anode 200.3, wherein low voltage cold anode 200.3 preferably includes Tungsten material. By the energizing of the Condensate return pipe 200.5 and Steam supply pipe 200.6 further provide circulation for water solution 200.9 and steam 200.10.

Anodes 200.2 and 200.3 are preferably coaxially aligned, wherein arc point 200.1.1 is formed there between, with a maximum effective electrical arc achieved when the dimensions of arc point 200.1.1 are a few tenths of an inch or less to maintain the arc plasma point. The spark, -or arc, is produced by high current pulse discharge flowing from high current hot anode 200.2 to low voltage anode 200.3. The optimal gap distance is selected by controller 200.8 via pneumatic signal 200.8.1 from controller 200.13, wherein controller 200.8 responds to signals from electrical feedback from electrical signal received thru terminal 200.4.2.

Ionization of water and biomass takes place at arc point 200.1.1. In the preferred embodiment, controller 200.8 automatically adjusts the gap of the arc-plasma point 200.1.1 to maintain the optimum gap distance by controlling electrode 200.2 to optimize the level of steam production relative to electrical power generation as sensed via electrical activity feedback of terminal 200.4.2. High current hot anode 200.2 position relative to the optimum gap distance is preferably controlled by in or out motion by controller 200.8 to maintain the most optimum energy of arc discharge.

Terminals 200.2.2 and 200.3.2 connected to Electrical system 300 deliver electrical energy to produce a high current arc and Electrical energy reclaim grid 200.4 preferably collects and stores energy formed by the arc discharge and by the magnetic field formed from the collapse of the arc discharge at arc point 200.1.1. As previously discussed, Electrical energy reclaim grid 200.4 comprises metal cylindrical ring forms preferably made out of copper imbedded in PYREX ring 200.4.3, wherein PYREX ring 200.4.3 is preferably disposed within Steam generation system 200 proximate arc point 200.1.1.

Figure 3:
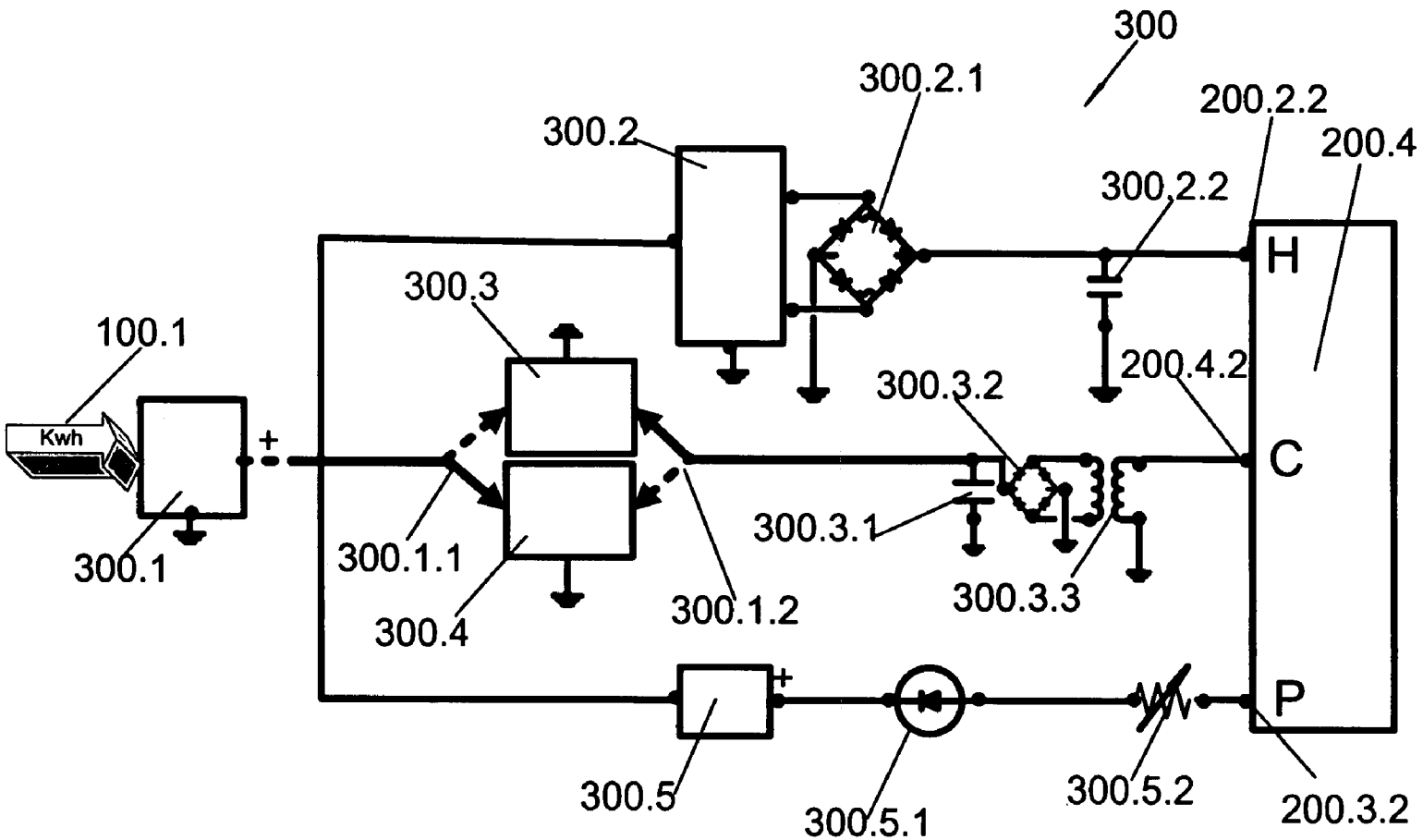
FIG. 3 is a schematic diagram of the electrical circuitry of an arc-hydrolysis steam generator according to the preferred embodiment of the present invention.

Electrical energy reclaim grid 200.4 preferably collects the magnetic field energy after collapse of the magnetic field, wherein the energy collected is preferably utilized to re-charge batteries 300.3 and 300.4 (as shown in FIG. 3). Collection and reuse of this energy increases the electrical efficiency of the present invention, preferably collecting between 50 to 60% of the electrical energy utilized by the spark at arc point 200.1.1. PYREX ring 200.4.3, with Electrical energy reclaim grid 200.4, is preferably disposed around and proximate arc point 200.1.1, wherein Electrical energy reclaim grid 200.4 is in electrical communication with collector cable 200.4.2 via collector electrode terminal 200.4.2, and wherein collector electrode terminal 200.4.2 delivers electrical energy to batteries 300.3 and 300.4 (as shown in FIG. 3) for storage.

In the preferred embodiment, Steam generation system 200 also includes temperature transducer 200.7.1 and pressure transducer 200.7, wherein temperature transducer 200.7.1 and pressure transducer 200.7 monitor temperature and pressure, respectively, within Steam generation system 200 via Pressure controlling valves 200.5.1 and 200.6.1. The fluid level in Steam generation system 200 is monitored via liquid level transducer 200.7.2.

The quantity of solution 200.9 and the rate of flow of steam 200.10 through the Steam generation system 200 are controlled by pump 100.6 according to the parameters of the pressure setpoint as desired. The greater the electrical energy disposed to the electrodes, the faster the flow of fluid, internal pressure and temperature through arc point 200.1.1, the bigger the volume of steam produced; therefore, by increasing the flow of solution 200.9 and increasing current, the volume of steam is be increased.

Pressure for a particular application can be adjusted preferably between atmospheric pressure to 200 psi, depending on the amount of steam required, wherein the higher the pressure, the higher the amount of steam generated. Preferably modulating of the speed of pump 100.6, and varying the pressure setpoint via pressure reducing valve control 200.5.1 and 200.6.1, controls the pressure inside Steam generation system 200. Pressure transducer 200.7 preferably reads the pressure in the Steam generation system chamber 200.9.1 and communicates same to pressure reducing valves 200.5.1 and 200.6.1 in a direct controlling way, the higher the pressure the higher the steam volume produced.

Referring now more specifically to FIG. 3 exhibits the Electrical system 300, Supplemental electrical power conditioner 300.1 is preferably in electrical communication with Low DC to high AC converter 300.2, First full bridge rectifier 300.2 and grounded capacitor 300.2.2. First full bridge rectifier 300.2.1 preferably obtains direct current from DC/AC converter 300.2 wherein DC/AC converter 300.2 converts low voltage direct current into high voltage alternating current and then converted to high potential/high current DC by first full bridge rectifier 300.2.1, thereby to maintain a high potential across capacitor 300.2.2 and to terminal 200.2.2.

Preferably DC/AC converter 300.2 is in electrical communication with switch 300.1.1, first battery 300.3, and second battery 300.4. DC/AC converter 300.2 is preferably also in electrical communication with High frequency solid-state switching device 300.5 and Supplemental electrical power conditioner 300.1, wherein Supplemental electrical power conditioner 300.1 is fed by External power supply 100.1. High frequency solid-state pulse switching device 300.5 is preferably controlled to time the low voltage high frequency, high amperage DC pulse to electrode 200.3.2.

In the preferred embodiment, collector electrode terminal 200.4.2 is in electrical communication with transformer 300.3.3, and transformer 300.3.3 is in electrical communication with second full bridge rectifier 300.3.2, wherein second full bridge rectifier 300.3.2 is grounded through capacitor 300.3.3. Capacitor 300.3.3 is, preferably rated at 12 μF and 5 kVA or higher; other ratings and/or capacitors could be alternately utilized to fit the potential necessary for the application.

Second full bridge rectifier 300.3.2 and Capacitor 300.3.3 are preferably in electrical communication with first battery 300.3 and second battery 300.4, thereby providing pulsed reclaimed energy thru DC current to charge batteries 300.3 or 300.4 respectively as permitted by switch 300.1.2.

In the preferred configuration, cold electrode terminal 200.3.2 is in electrical communication with variable resistance 300.5.2, wherein variable resistance 300.5.2 is in further electrical communication with fast response diode 300.5.1, and wherein variable resistance 300.5.2 provides control and protection against excessive energy draw from batteries 300.3 and 300.4. Fast response diode 300.5.1 is preferably in electrical communication with High frequency solid-state pulse switching device 300.5 to insure the flow of current in the direction of the High frequency solid-state pulse-switching device 300.5. Fast sharp and high frequency low voltage/high amperage pulses and briskly terminated are required to maintain the required arc-plasma event 200.1.1, those pulses are controlled by High frequency solid-state pulse switching device 300.5.

The preferred electrical circuitry for providing arc discharges and for recovering energy therefrom can be divided into three main circuits:

1) Circuit H provides the requisite high direct current power, (preferably approximately 5 kVA) to high voltage hot anode 200.2. Circuit H provides power, preferably direct high current power from batteries 300.3 and 300.4, via DC/AC converter 300.2, wherein DC/AC converter 300.2 raises the voltage potential supplied to full bridge rectifier 300.2.1. Full bridge rectifier 300.2.1 provides output to high energy/high amperage hot anode 200.2 thru capacitor 300.2.2, wherein high capacity capacitor 300.2.2 is sequentially charged and discharged to provide pulses to high voltage hot anode 200.2.2.

High voltage hot anode 200.2 is provided for a typical application with about 30 to 300 volts, at 200 amps or greater depending on application, depending on desired power output across anodes 200.3 and 200.2, creating an arc discharge at arc point 200.1.1. High amperage pulsed energy from low voltage cold anode 200.3 forms an arc plasma for ionization of solution 200.9, creating an electromagnetic event and a clearly visible light.

2) Circuit P provides low voltage pulse switching required by low voltage cold anode 200.3 for initiating the arc discharge. Continuity pulses are preferably provided by High frequency solid-state pulse switching device 300.5 via fast response diode 300.5.1. Fast response diode 300.5.1 acts as a barrier to insure current flow in the direction of the High frequency solid-state pulse-switching device 300.5. High frequency solid-state pulse switching device 300.5 preferably provides an adjustable contact pulse of about 12 volts or higher, 200 amps or greater, for approximately 0.00005 to 0.01 second pulse durations with an equally adjustable off time proportional to the maximum optimal ration of ionization rate versus the recycling rate of electrical energy.

3) Circuit C includes Electrical energy reclaim grid 200.4, wherein Electrical energy reclaim grid 200.4 captures the short duration electromagnetic pulsating energy field of the magnetic plasma as the plasma is repeated created and the magnetic field repeatedly collapses after the arc has ceased to exist. Electrical energy is collected by Electrical energy reclaim grid 200.4 around arc point 200.1.1, and anodes 200.3 and 200.2, wherein the energy then travels to transformer 300.3.3 and subsequently to second full bridge rectifier 300.3.2, thereby charging batteries 300.3 and 300.4, and wherein the energy is filtered by capacitor 300.3.3.

Batteries 300.3 and 300.4 are preferably deep cycle battery types, rated at 12 volts or higher and 200 Ampere-hours, wherein batteries 300.3 and 300.4 preferably deliver a minimum steady 20 Amperes for at least 5 hours.

A plurality of batteries are utilized to enable selective output and collection of the energy, wherein batteries 300.3 and 300.4 are preferably alternately charged and discharged.

Once an electrical arc has been started in the steam generation system 200, water in solution 200.9 preferably becomes super-conducting, wherein the resistance of water collapses to very low impedance and the volume of steam produced is directly proportional to the size of the arc between anodes 200.3 and 200.2, and proportional to the quantity of fluid pumped through Steam generation system 200. (Unlike electric arc discharges in air, the gap of the arc within a liquid can be increased in length utilizing an increase in the electric current.)

The greater the amount of electrical energy disposed to the electrodes, the greater the pressure, temperature, the faster the flow of fluid through Steams generation system 200, the larger the arc produced therein, and the greater the volume of steam produced. Therefore, by increasing fluid flow and electrical current flow, the volume of steam produced is increased. The size of the arc and the amount of frequency and size of the pulse is preferably controlled by the pulse of solid-state pulse controller 300.5.

Figure 4:
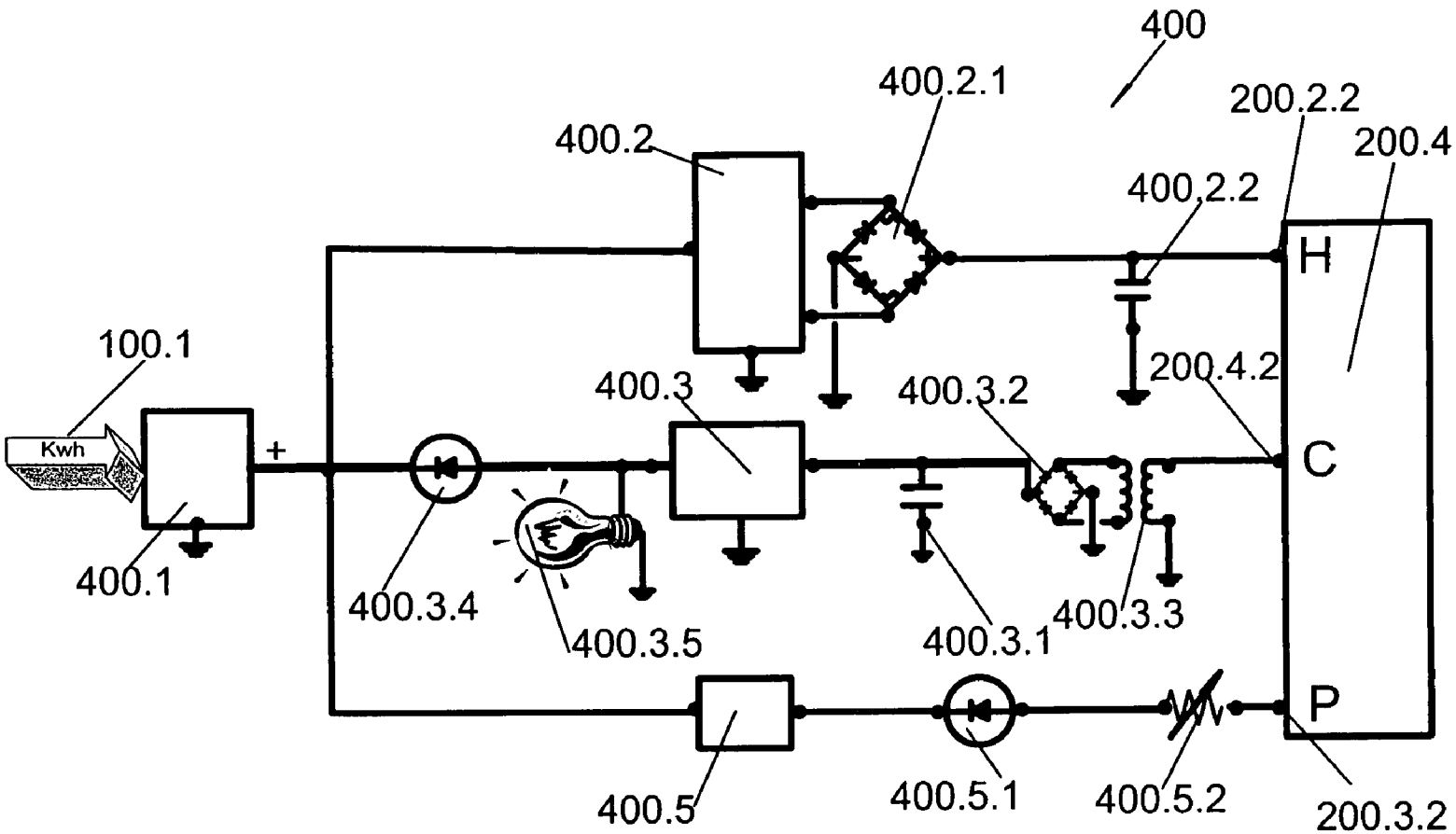
FIG. 4 is a schematic diagram of the electrical circuitry of an arc-hydrolysis steam generator according to the alternate embodiment of the present invention.

Referring now more specifically to Alternate embodiment as shown on FIG. 4, which exhibits the Electrical system 400. Electrical system 400 is very similar in operation to Electrical system 300 shown in FIG. 3, the main difference is that this system uses only one battery 400.3, wherein Battery 400.3 acts both as a means of storage of collected electrical energy and as a provider of DC electrical to both Low DC to high AC converter 400.2 and High frequency solid-state switching device 400.5. Diode 400.3.4 forces the electrical current to move in the direction of the of the Supplemental electrical power conditioner 400.1 wherein the battery 400.3 is used as another DC source to provide current to both Low DC to high AC converter 400.2 and High frequency solid-state pulse switching device 400.5.

Electrical system 400 depicts Electrical load 400.3.5 which can be powered by the terminal 200.4.2.

For both Electrical system 300 and 400 as shown respectively in FIGS. 3 and 4 requires an amount of external electrical energy to start and to promote the process, this is accomplished thru the Supplemental external source 100.1. The Supplemental external source 100.1 provides the differential energy required to the arc-plasma process 200.1.1 to continue the process, that differential is the net difference between the energy required and the electrical energy reclaimed. The Supplemental external source 100.1 can be any source DC or AC i.e. a portable fuel electrical generator or a plug to any electrical stationary source.

Figure 5:
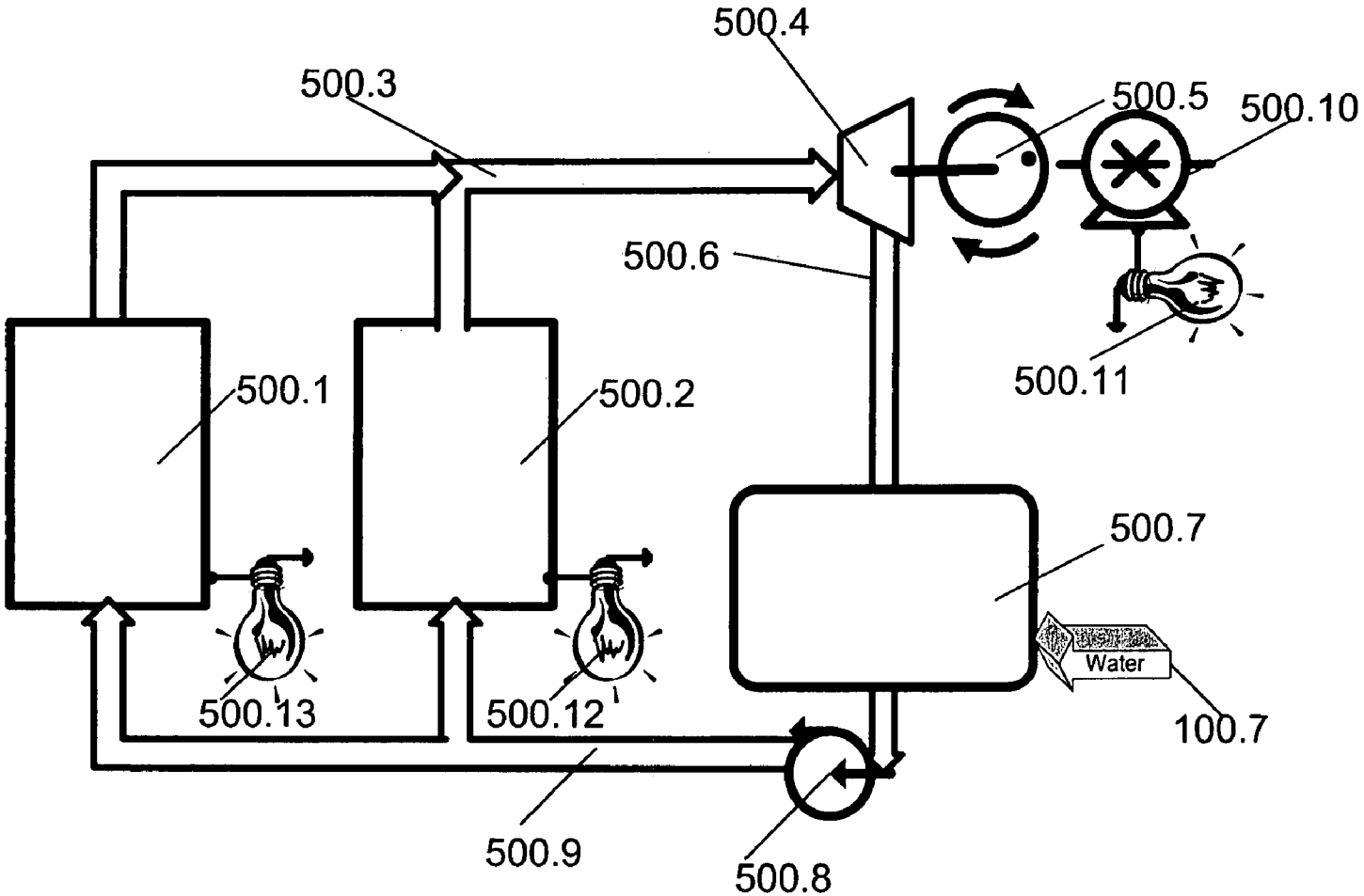
FIG. 5 is a block diagram of a steam/electricity generation process of an arc-hydrolysis steam generator according to an alternate embodiment of the present invention.

Referring now more particularly to FIG. 5, illustrated herein is an alternate embodiment of arc-hydrolysis steam generator 10, wherein the alternate embodiment of FIG. 5 is substantially equivalent in form and function to that of the preferred embodiment detailed and illustrated in FIG. 1, depicted herein is alternate system generation system 500, wherein supply system 500 preferably uses two or more Steam generation systems and re-circulates steam 200.10 and condensate 200.9 through a dual Steam generation system 500.

Steam generation system 500.1 and 500.2 vessel's preferably both operate at a very high temperature (5000 to 6000 degrees Fahrenheit). For two (2) standard 100 KWh arc-hydrolysis steam generator 10, about 680,000 BTU/hour (200 KWh) or more are in need to be utilized, dissipated or removed; otherwise, the process will generate excessive heat which will be wasted and will destroy the system itself otherwise. Supply pipe 500.3 and water vapor recovery system 500.6 preferably functions to keep Steam generation system 500 re-circulating provided with water solution 200.9 by using Pump 500.8 and to push, by its own pressure in the vessel, the excess heat away in the form of steam to Steam turbine 500.4 for use in producing rotational energy which can be utilized to generate electricity thru a generator unit or for transportation purposes. That is, the heat in the form of steam is preferably utilized to power the Steam turbine unit 500.4 to produce rotational energy; however, the generated steam can be used contiguously thru the use of a heat exchanger for other uses such as a heating source for use in heating homes and buildings as well as other uses.

Pump 500.8, Steam turbine 500.4, Steam generating units 500.1 and 500.2 as well as pipes 500.3, 500.6 and 500.9, respectively, can be designed and sized by one skilled in the art to facilitate the desired output capacity and heating requirements.

Condensate supply tank 500.7 preferably provides water as electrolyte for re-circulation to Steam generation systems 500.1 and 500.2 providing water 200.9 as required. Water level transducers preferably controls water supply valve 200.5.2 to maintain the proper supply of water.

It is contemplated in the alternate embodiment of the present invention that a plurality of Steam generation systems 200 units in series and parallel could be utilized either in a single arc-hydrolysis steam generator 10 or as a combination of a plurality of arc-hydrolysis steam generators 10.

It is shown in the alternate embodiment FIG. 5 of the present invention that electrical energy can be generated at two levels a) Primary electrical energy can be generated as shown using Electrical generator 500.10 as driven by Steam turbine 500.4 powering a external load(s) 500.11 and/or b) Secondary electrical energy loads 500.12 and 500.13 as driven by their respective electrical energy reclaim grid 200.4.

It is envisioned in an alternate embodiment of the present invention that alternating current could be utilized in lieu of direct current, wherein the pulses could have positive and negative components.

It is envisioned in yet another alternate embodiment of the present invention that sea water could be electrolyzed to produce steam, wherein the salt is separated and steam is produced then the salt is separated via combustion, or the like, to form salt-free water suitable for consumption by condensation and other uses.

It is contemplated in still another alternate embodiment of the present invention that sewage water could be cleaned by electrolysis in a similar fashion by the arc-hydrolysis steam generator 200, while concurrently producing steam.

It is contemplated in still yet another alternate embodiment of the present invention that a single battery 300.3, and/or other means for electrical energy storage, could be utilized, or that several batteries, and/or other electrical energy storage means, could be utilized in lieu of batteries 300.3 and 300.4.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

What is claimed is:

1. An arc-hydrolysis steam generator apparatus comprising:

a high-pressure vessel;

one pair of Tungsten rigid electrodes;

an electrical system to energize the arc;

an arc discharge unit with adjusting gap control;

a steam turbine and gears to transmit rotational energy;

a condensate tank;

a condensate pump;

at least one storage battery;

piping to circulate the steam and condensate; water liquid to convert into steam and means for induction disposed around said arc discharge unit.

2. The arc-hydrolysis steam generator apparatus of claim 1, wherein said means for induction is a magnetic energy recovery device.

3. The arc-hydrolysis steam generator apparatus of claim 1, wherein said means for generating electricity and power loads at two levels:

Primary level using steam and electrical generators, and

Secondary level using the reclaimed electrical energy.

4. The archydrolysis steam generator apparatus of claim 1, further comprising a water solution comprised of water in solution with salt (NaCl) to promote electrical conductivity for archydrolysis.

5. The arc-hydrolysis steam generator apparatus of claim 1, wherein said means for energy storage comprises at least one battery.

6. The arc-hydrolysis steam generator apparatus of claim 1, further comprising high energy direct current pulses to promote the arc-hydrolysis.

7. The archydrolysis steam generator apparatus of claim 1, further comprising high amperage alternate current pulses to promote the arc-hydrolysis.

8. An energy-efficient steam generation system, comprising:

liquid water source material contained in a pressurized vessel, wherein said pressurized vessel is a circulating water and steam pressurized chamber;

an external power supply;

an arc-hydrolysis device comprising a temperature control system, a pressure control system, a submerged low voltage cold anode, a submerged high voltage hot anode, and an arc point defined between said anodes, said arc-hydrolysis unit powered by said power supply and said arc-hydrolysis unit adapted to generate a high voltage pulse proximate said arc point;

a liquid water source transport system adapted to enable flow of said liquid water source material between said pressurized vessel and said arc-hydrolysis device, wherein said liquid water source material is ionized into steam at said arc point, and wherein heat and magnetic energy are coincidentally generated;

at least one battery;

an electrical energy reclaim grid, said electrical energy reclaim grid carried proximate said arc point, and said electrical energy reclaim grid adapted to collect magnetic energy and to convert said collected magnetic energy and to transmit said collected magnetic energy to said at least one battery;

a steam recovery system comprising a water condensate recovery system adapted to enable flow of said recovered condensate to said pressurized vessel;

a storage tank for said condensate;

a steam transport system adapted to enable flow of said steam between said archydrolysis unit and a steam turbine, said steam turbine having an exhaust, wherein said exhaust is directed to said water condensate recovery system; an electrical generator, said electrical generator driven by said steam turbine, wherein at least a portion of electrical energy produced by said electrical generator is collected and utilized to power said power supply and, an electrical generator, said electrical generator driven by said steam turbine, wherein at least a secondary portion of electrical energy is reclaimed by an electrical energy reclaim grid and is utilized to power other external loads.

* * * * *